US010221472B2

(12) United States Patent
Nakanishi et al.

(10) Patent No.: US 10,221,472 B2
(45) Date of Patent: Mar. 5, 2019

(54) STRUCTURAL ALUMINUM ALLOY PLATE AND METHOD OF PRODUCING THE SAME

(71) Applicant: UACJ Corporation, Tokyo (JP)

(72) Inventors: Hidetaka Nakanishi, Tokyo (JP); Kazushige Norikane, Tokyo (JP); Mineo Asano, Tokyo (JP)

(73) Assignee: UACJ CORPORATION, Tokyo (JP)

( * ) Notice: Subject to any disclaimer, the term of this patent is extended or adjusted under 35 U.S.C. 154(b) by 130 days.

(21) Appl. No.: 15/123,896

(22) PCT Filed: Nov. 13, 2014

(86) PCT No.: PCT/JP2014/080110

§ 371 (c)(1),
(2) Date: Sep. 6, 2016

(87) PCT Pub. No.: WO2015/133011

PCT Pub. Date: Sep. 11, 2015

(65) Prior Publication Data

US 2017/0016102 A1 Jan. 19, 2017

(30) Foreign Application Priority Data

Mar. 6, 2014 (WO) ..... PCT/JP2014/055791

(51) Int. Cl.
*C22C 21/10* (2006.01)
*C22F 1/053* (2006.01)
*C22F 1/00* (2006.01)

(52) U.S. Cl.
CPC ..... *C22F 1/053* (2013.01); *C22C 21/10* (2013.01); *C22F 1/002* (2013.01); *C22F 1/00* (2013.01)

(58) Field of Classification Search
None
See application file for complete search history.

(56) References Cited

U.S. PATENT DOCUMENTS

2003/0219353 A1 11/2003 Warner et al.
2005/0072497 A1 4/2005 Eberl et al.
2010/0012229 A1 1/2010 Oskarsson et al.
2010/0183899 A1* 7/2010 Asano ..... C22C 21/02 428/687
2015/0059934 A1* 3/2015 Shinzato ..... C22F 1/053 148/502
2015/0218677 A1* 8/2015 Aruga ..... C22C 21/10 420/532

FOREIGN PATENT DOCUMENTS

JP 2001064757 A 3/2001
JP 20050528521 A 9/2005
JP 20050530032 A 10/2005
JP 2008190027 A 8/2008
JP 2009114514 A 5/2009
JP 4285916 B2 6/2009
JP 4712159 B2 6/2011
JP 5083816 B2 11/2012

OTHER PUBLICATIONS

Translation of JP 2009-114514 (published May 28, 2009) from Espacenet.*
English Translation of the International Preliminary Report on Patentability and Written Opinion dated Sep. 6, 2016 for Application No. PCT/JP2014/055791, filed Mar. 6, 2014.
International Search Report and Written Opinion dated Jan. 6, 2015 for International Application No. PCT/JP2014/080110, filed Nov. 13, 2014.
English Translation of the International Search Report and Written Opinion dated Jan. 6, 2015 for International Application No. PCT/JP2014/080110, filed Nov. 13, 2014.
Hiroki Takeda et al., "Effect of Cold Rolling Reduction on Development of Recrystallization Textures in an Al—Mg—Si Alloy", Furukawa-Sky Review, No. 9, 2013, pp. 18-25—English Abstract.

* cited by examiner

*Primary Examiner* — George Wyszomierski
(74) *Attorney, Agent, or Firm* — David D. Brush; Westman, Champlin & Koehler, P.A.

(57) ABSTRACT

A structural aluminum alloy plate includes 7.0% to 12.0% by mass of Zn, 1.5% to 4.5% by mass of Mg, 1.0% to 3.0% by mass of Cu, 0.05% to 0.30% by mass of Zr, 0.005% to 0.5% by mass of Ti, 0.5% or less by mass of Si, 0.5% or less by mass of Fe, 0.3% or less by mass of Mn, 0.3% or less by mass of Cr, and the balance that includes aluminum and inevitable impurities. A method of producing the structural aluminum alloy plate is also provided.

3 Claims, No Drawings

STRUCTURAL ALUMINUM ALLOY PLATE AND METHOD OF PRODUCING THE SAME

CROSS-REFERENCE TO RELATED APPLICATIONS

This Application is a Section 371 National Stage Application of International Application No. PCT/JP2014/080110, filed Nov. 13, 2014, the content of which is incorporated herein by reference in its entirety, and published as WO 2015/133011 on Sep. 11, 2015, not in English, which claims the benefit of International Patent Application No. PCT/JP2014/055791 filed on Mar. 6, 2014 with the Japan Patent Office as a receiving office, and the entire disclosure of International Patent Application No. PCT/JP2014/055791 is incorporated herein by reference.

TECHNICAL FIELD

The present invention relates to a structural aluminum alloy plate, more specifically, to a structural Al—Zn—Mg—Cu aluminum alloy plate, and also relates to a method of producing the same.

BACKGROUND ART

Aluminum alloy has been conventionally and widely used as a structural material for aircrafts, spacecrafts, and vehicles due to its characteristic as having a specific gravity lower than that of iron and steel materials. The aluminum alloy, as being the structural material, has been desired to further reduce its weight, and at the same time, the aluminum alloy has been desired to have high strength. For example, Patent Documents 1 to 3 have proposed an aluminum alloy having increased strength.

PRIOR ART DOCUMENTS

Patent Documents

Patent Document 1: Japanese Patent No. 4285916
Patent Document 2: Japanese Patent No. 4712159
Patent Document 3: Japanese Patent No. 5083816

SUMMARY OF THE INVENTION

Problems to be Solved by the Invention

In order to satisfy the demand for an aluminum alloy having increased strength, however, use of a conventional production method to increase the strength causes a problem of low ductility. The low ductility is not favorable as the structural material, and thus, if the ductility is improved, the strength generally decreases. Accordingly, with the conventional production method, it is difficult to produce an aluminum alloy plate that exhibits high strength and high ductility at the same time. Also, an aluminum alloy plate produced by rolling has strength and ductility in a rolling direction (a 0-degree direction to the rolling direction), which are different from strength and ductility in a 45-degree direction and a 90-degree direction to the rolling direction (this is called as in-plane anisotropy). Especially, the strength in the 45-degree direction is likely to be smaller than the strength in the 0-degree direction and that in the 90-degree direction, whereas ductility in the 0-degree direction and that in the 90-degree direction are likely to be smaller than the ductility in the 45-degree direction (i.e., the in-plane anisotropy is large).

In view of the above, in one aspect of the present invention, it is desirable to provide an structural aluminum alloy plate with excellent strength and excellent ductility and as well as small in-plane anisotropy, and also to provide a method of producing the structural aluminum alloy plate.

Means for Solving the Problems

A structural aluminum alloy plate in one aspect of the present invention comprises, as its components, 7.0% to 12.0% by mass of Zn, 1.5% to 4.5% by mass of Mg, 1.0% to 3.0% by mass of Cu, 0.05% to 0.30% by mass of Zr, 0.005% to 0.5% by mass of Ti, 0.5% or less by mass of Si, 0.5% or less by mass of Fe, 0.3% or less by mass of Mn, 0.3% or less by mass of Cr, and, other than the aforementioned components, the balance that comprises aluminum and inevitable impurities. Moreover, the structural aluminum alloy plate comprises a texture in which an orientation density of at least one crystal orientation of three crystal orientations, which are Brass orientation, S orientation, and Copper orientation, is 20 or more in random ratio, and in which an orientation density of each of five crystal orientations, which are Cube orientation, CR orientation, Goss orientation, RW orientation, and P orientation, is 10 or less in random ratio. The structural aluminum alloy plate comprises a tensile strength of 660 MPa or more and a 0.2% yield strength of 600 MPa or more, in each of a 0-degree direction and a 90-degree direction with respect to a longitudinal rolling direction. The structural aluminum alloy plate comprises an elongation at break in each of the 0-degree direction and the 90-degree direction, which is 70% or more of an elongation at break in a 45-degree direction with respect to the longitudinal rolling direction. The structural aluminum alloy plate comprises a tensile strength in the 45-degree direction, which is 80% or more of the tensile strength in the 0-degree direction, and comprises a 0.2% yield strength in the 45-degree direction, which is 80% or more of the 0.2% yield strength in the 0-degree direction. The structural aluminum alloy plate comprises the elongation at break in the 45-degree direction, which is 12% or more.

A method for producing the structural aluminum alloy plate in one aspect of the present invention comprises, as its components, 7.0% to 12.0% by mass of Zn, 1.5% to 4.5% by mass of Mg, 1.0% to 3.0% by mass of Cu, 0.05% to 0.30% by mass of Zr, 0.005% to 0.5% by mass of Ti, 0.5% or less by mass of Si, 0.5% or less by mass of Fe, 0.3% or less by mass of Mn, 0.3% or less by mass of Cr, and the balance being aluminum and inevitable impurities. The production method comprises hot rolling under conditions where a total reduction ratio is 90% or more, a strain rate is 0.01 $s^{-1}$ or more, a reduction ratio per 1 pass is 1% or more, a total number of rolling passes is 10 passes to 70 passes in which 50% or more of the total number of rolling passes is reverse rolling, and a start temperature is 300° C. to 420° C., after the hot rolling, solution treating at a temperature of 400° C. to 480° C. for 1 hour to 10 hours, after the solution treating, quenching to cool down to a temperature of 90° C. or below within one minute, and after the quenching, artificially aging at a temperature of 80° C. to 180° C. for 5 hours to 30 hours.

The aforementioned production method may further comprise cold rolling between the hot rolling and the solution treating.

The aforementioned production method may further comprise free forging prior to the hot rolling.

According to one aspect of the present invention, it is possible to provide a structural aluminum alloy plate that is excellent in strength and ductility and has small in-plane anisotropy.

MODE FOR CARRYING OUT THE INVENTION

Hereinafter, embodiments of the present invention will be described. However, the present invention is not limited to the below-described embodiments, and can be carried out in various modes without departing from the scope of the present invention. In addition, configurations obtained by appropriately combining different embodiments can be included in the scope of the present invention.

A structural aluminum alloy plate of the present invention belongs to Al—Zn—Mg—Cu aluminum alloy, which is known as 7000 series alloy. That is, the structural aluminum alloy plate of the present embodiment is an Al—Zn—Mg—Cu aluminum alloy plate and hereinafter, simply referred to as a structural aluminum alloy plate.

The structural aluminum alloy plate of the present embodiment comprises, as main components, zinc (Zn), magnesium (Mg), copper (Cu), zirconium (Zr), titanium (Ti), silicon (Si), iron (Fe), manganese (Mn), and chromium (Cr). Also, the structural aluminum alloy plate comprises, as the balance, inevitable impurities and aluminum (Al). Each of these components will be explained below. It is to be noted that in the specification hereinafter, "% by mass" is simply indicated as "%".

(1) Zn

Zn increases strength of an aluminum alloy. When Zn content in an aluminum alloy is less than 7.0%, the effect of increasing strength of the aluminum alloy cannot be obtained. Also, when the Zn content exceeds 12.0%, Zn—Mg based crystallized products and precipitates are formed, causing reduction in ductility of the aluminum alloy. Accordingly, in the structural aluminum alloy plate of the present embodiment, the Zn content is 7.0% to 12.0%. Moreover, it is preferable that the Zn content is 8.0% to 11.0%.

(2) Mg

Mg increases strength of an aluminum alloy. When Mg content in an aluminum alloy is less than 1.5%, the effect of increasing strength of the aluminum alloy cannot be obtained. Also, when the Mg content exceeds 4.5%, Zn—Mg based and Al—Mg—Cu based crystallized products and precipitates are formed, causing reduction in ductility of the aluminum alloy. Accordingly, in the structural aluminum alloy plate of the present embodiment, the Mg content is 1.5% to 4.5%. Moreover, it is preferable that the Mg content is 1.5% to 3.5%.

(3) Cu

Cu increases strength of an aluminum alloy. When Cu content in an aluminum alloy is less than 1.0%, the effect of increasing strength of the aluminum alloy cannot be obtained. Also, when the Cu content exceeds 3.0%, Al—Cu based and Al—Mg—Cu based crystallized products and precipitates are formed, causing reduction in ductility of the aluminum alloy. Accordingly, in the structural aluminum alloy plate of the present embodiment, the Cu content is 1.0% to 3.0%. Moreover, it is preferable that the Cu content is 1.0% to 2.5%.

(4) Zr

Zr inhibits recrystallization in an aluminum alloy during solution treatment and increases strength of the aluminum alloy. When Zr content in an aluminum alloy is less than 0.05%, recrystallization in the aluminum alloy cannot be inhibited and therefore, the effect of increasing strength of the aluminum alloy cannot be obtained. Also, when the Zr content exceeds 0.30%, Al—Zr based crystallized products and precipitates are formed, causing reduction in ductility of the aluminum alloy. Accordingly, in the structural aluminum alloy plate of the present embodiment, the Zr content is 0.05% to 0.30%. Moreover, it is preferable that the Zr content is 0.05% to 0.20%.

(5) Ti

Ti is a component contained in a refiner that is added for refining crystal grains of an ingot. When Ti content in an aluminum alloy exceeds 0.5%, Al—Ti based crystallized products and precipitates are formed, causing reduction in ductility of the aluminum alloy. Also, when the Ti content is less than 0.005%, the sufficient effect of refinement of crystal grains of an ingot cannot be obtained. Accordingly, in the structural aluminum alloy plate of the present embodiment, the Ti content is 0.005% to 0.5%. Moreover, it is preferable that the Ti content is 0.35% or below.

(6) Si

Si reduces ductility of an aluminum alloy. When Si content in an aluminum alloy exceeds 0.5%, Al—Fe—Si based and Si based crystallized products and precipitates are formed, causing reduction in ductility of the aluminum alloy. Accordingly, in the structural aluminum alloy plate of the present embodiment, the Si content is limited to be 0.5% or less. Moreover, it is preferable that the Si content is 0.4% or less.

(7) Fe

Fe reduces ductility of an aluminum alloy. When Fe content in an aluminum alloy exceeds 0.5%, Al—Fe—Si based and Al—Fe based crystallized products and precipitates are formed, causing reduction in ductility of the aluminum alloy. Accordingly, in the structural aluminum alloy plate of the present embodiment, the Fe content is limited to be 0.5% or less. Moreover, it is preferable that the Fe content is 0.35% or less.

(8) Mn

Mn reduces ductility of an aluminum alloy. When Mn content in an aluminum alloy exceeds 0.3%, Al—Mn based and Al—Fe—Si—Mn based crystallized products and precipitates are formed, causing reduction in ductility of the aluminum alloy. Accordingly, in the structural aluminum alloy plate of the present embodiment, the Mn content is limited to be 0.3% or less. Moreover, it is preferable that the Mn content is 0.2% or less.

(9) Cr

Cr reduces ductility of an aluminum alloy. When Cr content in an aluminum alloy exceeds 0.3%, Al—Cr based crystallized products and precipitates are formed, causing reduction in ductility of the aluminum alloy. Accordingly, in the structural aluminum alloy plate of the present embodiment, the Cr content is limited to be 0.3% or less. Moreover, it is preferable that the Cr content is 0.2% or less.

(10) Aluminum and Inevitable Impurities

The structural aluminum alloy plate of the present embodiment contains, in addition to the above-described components (1) to (9), aluminum and inevitable impurities as the balance. The balance is generally known in the technical field of Aluminum Alloy and thus, detailed explanations thereof will not be provided here.

Each of the above-described Si, Fe, Mn, and Cr is a component whose content is limited. Accordingly, a structural aluminum alloy plate that does not at all contain these components whose contents are limited (i.e., the contents are 0) falls within the scope of the present invention.

Next, a crystal structure of the structural aluminum alloy plate of the present embodiment will be explained hereinafter.

Metal, such as the structural aluminum alloy plate of the present embodiment, is a polycrystalline material. In such a polycrystalline material, crystal grains are present, and distribution of crystal lattice orientations of the crystal grains (crystal orientation) is called "texture (crystal texture)".

Examples of representative crystal orientations present in an aluminum alloy plate are Brass orientation, S orientation, Copper orientation, Cube orientation, CR orientation, Goss orientation, RW orientation, P orientation, and so on. Properties of metal are specified based on at what volume fractions these orientations are included. Because these orientations described above are well-known to those skilled in the art, detailed explanations thereof will not be provided here.

(A) Brass Orientation, S Orientation, and Copper Orientation

Brass orientation, S orientation, and Copper orientation exhibit the effect of increasing strength. In a case where grains are less oriented in each of the crystal orientations and where orientation densities of all of the three crystal orientations are less than 20, the effect of increasing strength of the aluminum alloy cannot be obtained.

Thus, in the structural aluminum alloy plate of the present embodiment, orientation density of one or more crystal orientations, out of the three crystal orientations, i.e., Brass orientation, S orientation, and Copper orientation, is 20 or more (random ratio; the same shall apply hereinafter). In addition, out of these three crystal orientations, orientation density of one or more crystal orientations is preferably 25 or more.

(B) Cube Orientation, CR Orientation, Goss Orientation, RW Orientation, and P Orientation Cube orientation, CR orientation, Goss orientation, RW orientation, and P orientation are crystal orientations that are observed in a recrystallization texture; these orientations exhibit the effect of reducing strength of an aluminum alloy. In a case where orientation density of each of these orientations exceeds 10, in-plane anisotropy of the aluminum alloy increases, causing reduction in strength of the aluminum alloy.

Accordingly, in the structural aluminum alloy plate of the present embodiment, orientation densities (random ratio) of all of the five crystal orientations, i.e., Cube orientation, CR orientation, Goss orientation, RW orientation, and P orientation, are 10 or less. In addition, the orientation densities of all of the five crystal orientations are preferably 5 or less.

The structural aluminum alloy plate of the present embodiment, which has the aforementioned components and crystal structures, has the following property: tensile strength in each of a 0-degree direction and a 90-degree direction with respect to a longitudinal rolling direction is 660 MPa or more; 0.2% yield strength in each of the 0-degree direction and the 90-degree direction is 600 MPa or more; elongation at break in each of the 0-degree direction and the 90-degree direction is 70% or more of elongation at break in a 45-degree direction with respect to the longitudinal rolling direction; tensile strength in the 45-degree direction is 80% or more of the tensile strength in the 0-degree direction, and 0.2% yield strength in the 45-degree direction is 80% or more of the 0.2% yield strength in the 0-degree direction; and the elongation at break in the 45-degree direction is 12% or more.

Because the structural aluminum alloy plate according to the present embodiment has the aforementioned properties, it can be demonstrated that such a structural aluminum alloy plate exhibits sufficient strength and excellent ductility, and has small in-plane anisotropy. Therefore, according to the present invention, it is possible to obtain a structural aluminum alloy plate that is suitable for air crafts, spacecrafts, and vehicles, for example.

Next, a method of producing the structural aluminum alloy plate of the present embodiment will be described.

The production method of the present embodiment is a method of producing a structural aluminum alloy plate that comprises 7.0% to 12.0% of Zn, 1.5% to 4.5% of Mg, 1.0% to 3.0% of Cu, 0.05% to 0.30% of Zr, and 0.005% to 0.5% of Ti, 0.5% or below of Si, 0.5% or below of Fe, 0.3% or below of Mn, 0.3% or below of Cr, and the balance which are aluminum and inevitable impurities.

This production method comprises, at least, hot rolling, solution treating to be carried out after the hot rolling, quenching to be carried out after the solution treating, and artificial aging to be carried out after the quenching.

Also, the production method of the present embodiment may further comprise cold rolling between the hot rolling and the solution treating. Moreover, the production method of the present embodiment may further comprise free forging prior to the hot rolling.

Hereinafter, each of the aforementioned processes will be described in details.

(a) Hot Rolling

Hot rolling is a rolling process that is carried out while maintaining a temperature to be a specified temperature (for example, recrystallization temperature of metal) or greater. In the present embodiment, the hot rolling is carried out under the conditions that a total reduction ratio is 90% or higher, a strain rate is 0.01 $s^{-1}$ or more, a reduction ratio per 1 pass is 1% or more, a total number of rolling passes is 10 passes to 70 passes in which 50% or more of the total number of rolling passes is reverse rolling, and a start temperature is 300° C. to 420° C.

The total reduction ratio is a reduction ratio of a plate thickness of a rolled material in the rolling process. Also, the strain rate is a numerical value representing a reduction ratio of the plate thickness to a unit working time in the rolling process. Moreover, the reduction ratio per 1 pass is a reduction ratio of the plate thickness of the material during 1 pass of the rolling. Moreover, the reverse rolling is to repeatedly carry out rolling while making the material pass back and forth; the reverse rolling, in which a direction of the rolling is changed by 180 degrees for each pass, is distinguished from one-way rolling in which the rolling direction is always fixed.

As for the total reduction ratio in the hot rolling, the larger the numerical value of the total reduction ratio is, the higher orientation density of at least one orientation of Brass orientation, S orientation, and Copper orientation is; consequently, strength of the aluminum alloy is increased. If the total reduction ratio is less than 90%, the effect of improving strength of the aluminum alloy cannot be obtained. Moreover, the higher the total reduction ratio of hot rolling is, the smaller orientation densities of all of Cube orientation, CR orientation, Goss orientation, RW orientation, and P orientation are; consequently, in-plane anisotropy of the aluminum alloy is small and thus, strength of the aluminum alloy is increased. Accordingly, in the production method of the present embodiment, the total reduction ratio in the hot rolling is 90% or higher. In order to further reduce in-plane anisotropy and further enhance strength of a resulting structural aluminum alloy plate, it is preferable that the total reduction ratio in the hot rolling is 93% or higher.

Moreover, as for the strain rate in the hot rolling, the larger a numerical value of the strain rate is, the higher orientation density of at least one orientation of Brass orientation, S orientation, and Copper orientation is; consequently, strength of the aluminum alloy is increased. If the strain rate is less than 0.01 $s^{-1}$, necessary strength of the aluminum alloy cannot be achieved. Accordingly, in the production method of the present embodiment, the strain rate in the hot rolling is 0.01 $s^{-1}$ or more. In order to further increase strength of a resulting structural aluminum alloy plate, it is preferable that the strain rate in the hot rolling is 0.03 $s^{-1}$ or more.

In this regard, an upper limit of the total reduction ratio and an upper limit of the strain rate in the hot rolling are not specifically defined; however, in view of current production facilities, a reference value as the upper limit of the total reduction ratio is around 99% and a reference value as the upper limit of the strain rate is around 400 $s^{-1}$.

As for the reduction ratio per 1 pass of the hot rolling, the larger a numerical value thereof is, the higher orientation density of at least one orientation of Brass orientation, S orientation, and Copper orientation is; consequently, strength of the aluminum alloy is increased. If the reduction ratio per 1 pass is less than 1%, the effect of increasing strength of the aluminum alloy cannot be obtained. Accordingly, in the production method of the present embodiment, the reduction ratio per 1 pass is 1% or higher. In order to further increase strength of a resulting structural aluminum alloy plate, it is preferable that the reduction ratio per 1 pass is 1.5% or more. In this regard, an upper limit of the reduction ratio per 1 pass is not specifically defined; however, in view of current production facilities, a reference value as the upper limit is around 50%.

In the hot rolling, if the total number of rolling passes is large, a rolling reduction amount per 1 pass before a specified thickness is obtained is small. For this reason, a surface layer portion in a thickness direction of the plate has a higher priority to be hot-rolled than a center portion in the thickness direction of the plate and thus, the center portion in the thickness direction of the plate is less likely to be hot-rolled. Consequently, the textures in Brass orientation, S orientation, and Copper orientation do not develop. If the total number of rolling passes exceeds 70 passes, the effect of improving strength of the aluminum alloy cannot be obtained. On the other hand, if the total number of rolling passes is small, the rolling reduction amount per 1 pass before a specified thickness is obtained is large. For this reason, a strong shearing is applied to the surface layer portion in the thickness direction of the plate, and therefore, the textures in Brass orientation, S orientation, and Copper orientation do not develop. Consequently, orientation densities of Cube orientation, CR orientation, Goss orientation, RW orientation, and P orientation do not sufficiently decrease. If the total number of rolling passes is less than 10 passes, in-plane anisotropy of the aluminum alloy does not decrease; therefore, the effect of improving strength of the aluminum alloy cannot be obtained. Accordingly, in the production method of the present embodiment, the total number of rolling passes is 10 passes to 70 passes. In order to further increase strength of a resulting structural aluminum alloy plate, it is preferable that the total number of rolling passes is 20 passes to 60 passes.

As for rolling work in the hot rolling, the material can be rolled more uniformly by reverse rolling than by one-way rolling. In the case of reverse rolling, orientation density of at least one orientation of Brass orientation, S orientation, and Copper orientation increases. Also, orientation densities of all of Cube orientation, CR orientation, Goss orientation, RW orientation, and P orientation decrease. For this reason, the aluminum alloy has small in-plane anisotropy, thereby increasing strength of the aluminum alloy. In one-way rolling, rolling is not uniformly performed. As a result, the effect of improving strength of the aluminum alloy cannot be sufficiently obtained. Accordingly, in the production method of the present embodiment, 50% or more of the total number of rolling passes are reverse rolling. In order to reduce in-plane anisotropy and further enhance strength of a resulting structural aluminum alloy plate, it is preferable that 70% or more of the total number of rolling passes are reverse rolling.

If a hot-rolling start temperature is less than 300° C., because of a large deformation resistance of the material, rolling work is applied only to the surface layer portion in the thickness direction of the plate, but not sufficiently applied to the center portion in the thickness direction of the plate. Thus, the textures are less likely to develop in Brass orientation, S orientation, and Copper orientation; orientation densities of all of Cube orientation, CR orientation, Goss orientation, RW orientation, and P orientation do not decrease sufficiently. For this reason, in-plane anisotropy of the aluminum alloy does not decrease and therefore, the effect of improving strength of the aluminum alloy cannot be obtained. Moreover, because a rolling load increases and cracks in the material are likely to occur during the rolling, it is difficult to carry out the rolling work. On the other hand, if the rolling start temperature is higher than 420° C., deformation resistance of the material is small, and the material is easily deformed. Therefore, the textures are less likely to be developed in Brass orientation, S orientation, and Copper orientation; orientation densities of all of Cube orientation, CR orientation, Goss orientation, RW orientation, and P orientation do not sufficiently decrease. For this reason, in-plane anisotropy of the aluminum alloy does not decrease and therefore, the effect of improving strength of the aluminum alloy cannot be obtained. Accordingly, in the production method of the present embodiment, the rolling start temperature is in a range of 300° C. to 420° C.

(b) Cold Rolling

Cold rolling is a rolling process that is carried out at a temperature equal to or below a specified temperature (for example, recrystallization temperature of metal). In the present embodiment, this cold rolling may be carried out after the hot rolling. It is to be noted that, in the production method of the present invention, the cold rolling does not necessarily need to be carried out, and target mechanical properties can be sufficiently achieved without the cold rolling. However, if the cold rolling is carried out, the effect of improving the strength can be obtained.

As in the case of the hot rolling, in the cold rolling, the higher the total reduction ratio is, the more in-plane anisotropy of the aluminum alloy can be reduced and also, the more the effect of improving the strength of the aluminum alloy can be obtained.

Aside from the aforementioned conditions, conditions in the cold rolling are not particularly specified, and the cold rolling may be carried out under conditions used in cold rolling that is generally carried out in the technical field of the present invention.

(c) Solution Treatment

Solution treatment is a treatment to dissolve crystallized products and precipitates, which are present in metallic structures. In the present embodiment, this solution treatment is carried out after the hot rolling, or, if the cold rolling is carried out, after the cold rolling.

If a temperature of the solution treatment is less than 400° C., the material cannot be sufficiently dissolved and therefore, strength and ductility of the aluminum alloy cannot be sufficiently obtained. Moreover, in the solution treatment, if the temperature exceeds 480° C., which means that the temperature exceeds a solidus temperature of the material, partial melting occurs. Accordingly, in the production method of the present embodiment, the temperature of the solution treatment is specified in a range of 400° C. to 480° C. Moreover, in order to further improve strength and ductility of a resulting structural aluminum alloy plate, it is preferable that the temperature of the solution treatment is specified in a range of 420° C. to 480° C.

In the solution treatment, if a treatment time is less than 1 hour, the material cannot be sufficiently dissolved and therefore, strength and ductility of the aluminum alloy cannot be sufficiently obtained. Moreover, in the solution treatment, if the treatment time exceeds 10 hours, recrystallization occurs in a metallic structure of the material. As a result, orientation density of at least one orientation of Brass orientation, S orientation, and Copper orientation decreases and also, orientation densities of Cube orientation, CR orientation, Goss orientation, RW orientation, and P orientation increase. For this reason, in-plane anisotropy of the aluminum alloy is large and therefore, necessary strength of the aluminum alloy cannot be obtained. Accordingly, in the production method of the present embodiment, the solution treatment time is specified in a range of 1 hour to 10 hours. Moreover, in order to further improve strength and ductility of a resulting structural aluminum alloy plate, the solution treatment time is preferably 1.5 hours to 8 hours.

Aside from the aforementioned conditions, conditions in the solution treatment are not particularly specified, and the solution treatment may be carried out under conditions used in solution treatment that is generally carried out in the technical field of the present invention.

(d) Quenching

Quenching is a treatment to rapidly reduce a temperature of the material to around room temperature without causing precipitation of component elements that have been dissolved in the solution treatment (i.e., while maintaining the component elements in the dissolved state). Examples of the quenching include water quenching, in which rapid cooling is carried out by putting the material into water immediately after the solution treatment.

In the quenching, unless the material is cooled down to have a temperature of 90° C. or below within one minute, precipitation occurs during the quenching. In this case, dissolution cannot be sufficiently achieved, and necessary strength and ductility of the aluminum alloy cannot be obtained. Moreover, in order to further improve strength and ductility of a resulting structural aluminum alloy plate, it is more preferable that the material is cooled down to have a temperature of 80° C. or below within 50 seconds.

Aside from the aforementioned conditions, conditions in the quenching are not particularly specified, and the quenching may be carried out under conditions used in quenching that is generally carried out in the technical field of the present invention.

(e) Artificial Aging Treatment

If a temperature of artificial aging treatment is less than 80° C., precipitation does not occur and therefore, the effect of improving strength of the aluminum alloy by enhanced precipitation cannot be obtained. Moreover, if the temperature of the artificial aging treatment exceeds 180° C., coarse precipitates are formed and therefore, the effect of improving strength of the aluminum alloy by enhanced precipitation cannot be obtained. Accordingly, in the production method of the present embodiment, the temperature of the artificial aging treatment is specified in a range of 80° C. to 180° C. Moreover, in order to further improve strength of a resulting structural aluminum alloy plate, it is preferable that the temperature of the artificial aging treatment is in a range of 100° C. to 180° C.

If an artificial-aging treatment time is less than 5 hours, precipitation does not sufficiently occur and therefore, the effect of improving strength of the aluminum alloy by enhanced precipitation cannot be obtained. Moreover, if the artificial-aging treatment time exceeds 30 hours, coarse precipitates are generated and therefore, the effect of improving strength of the aluminum alloy cannot be obtained. Accordingly, in the production method of the present embodiment, the artificial-aging treatment time is specified in a range of 5 hours to 30 hours. Moreover, in order to further improve strength of a resulting structural aluminum alloy plate, it is preferable that the artificial-aging treatment time is 8 hours to 28 hours.

Aside from the aforementioned conditions, conditions in the artificial aging treatment are not particularly specified, and the artificial aging treatment may be carried out under conditions used in artificial aging treatment that is generally carried out in the technical field of the present invention.

(f) Free Forging

In the present embodiment, free forging may be carried out prior to the hot rolling.

By carrying out the free forging prior to the hot rolling, ingot structures are broken down, thereby improving strength and ductility of the aluminum alloy. It is to be noted that in the production method of the present invention, the free forging does not necessarily need to be carried out, target mechanical properties can be sufficiently achieved without the free forging. However, in a case where the free forging is carried out, the ingot structures are broken down, thereby improving strength and ductility of the aluminum alloy.

In the free forging, the higher a compression ratio is, the more the ingot structures are broken down, which results in improved strength and ductility of the aluminum alloy. Accordingly, in the production method of the present embodiment, the compression ratio is not particularly specified. However, in a case where the free forging is carried out, it is preferable that the compression ratio is 30% or more.

Aside from the aforementioned conditions, conditions in the free forging are not particularly specified, and the free forging may be carried out under conditions used in free forging that is generally carried out in the technical field of the present invention.

According to the production method of the present embodiment comprising the aforementioned processes (a) to (f), it is possible to produce a structural aluminum alloy plate having sufficient strength and excellent ductility, as well as having small in-plane anisotropy. Accordingly, with the present invention, a structural aluminum alloy plate that is suitable for air- and space-crafts and for vehicles, for example, can be obtained.

Embodiment

Hereinafter, embodiments of the present invention will be described in comparison with comparative examples, so as to demonstrate effects of the present invention. These embodiments merely illustrate one embodiment of the present invention, and the present invention is not at all limited to these embodiments.

Embodiment 1

In Embodiment 1, firstly, various aluminum alloys A to V, which contain metal elements in contents listed in Table 1, were cast by DC casting to produce ingots, each having a thickness of 500 mm and a width of 500 mm. It is to be noted that "Bal." in Table 1 refers to the balance (Balance).

TABLE 1

Chemical Composition of Each Test Material

| | Symbol | Component (Mass %) | | | | | | | | | |
|---|---|---|---|---|---|---|---|---|---|---|---|
| | | Si | Fe | Cu | Mn | Mg | Cr | Zn | Ti | Zr | Al |
| Embodiment | A | 0.23 | 0.11 | 2.1 | 0.01 | 2.9 | 0.02 | 10.1 | 0.05 | 0.13 | Bal. |
| | B | 0.22 | 0.12 | 1.3 | 0.05 | 3.0 | 0.09 | 11.2 | 0.23 | 0.12 | Bal. |
| | C | 0.21 | 0.11 | 2.8 | 0.03 | 3.1 | 0.12 | 10.8 | 0.32 | 0.11 | Bal. |
| | D | 0.19 | 0.13 | 2.0 | 0.02 | 1.7 | 0.06 | 9.8 | 0.12 | 0.10 | Bal. |
| | E | 0.18 | 0.10 | 2.1 | 0.04 | 4.3 | 0.08 | 9.5 | 0.16 | 0.13 | Bal. |
| | F | 0.20 | 0.14 | 1.9 | <0.01 | 3.5 | 0.14 | 7.5 | 0.09 | 0.09 | Bal. |
| | G | 0.19 | 0.09 | 2.3 | 0.02 | 3.4 | 0.10 | 11.8 | <0.01 | 0.15 | Bal. |
| | H | 0.02 | 0.01 | 2.4 | 0.07 | 2.9 | <0.01 | 9.5 | 0.02 | 0.13 | Bal. |
| | I | 0.44 | 0.39 | 2.2 | 0.23 | 3.2 | 0.19 | 10.5 | 0.43 | 0.10 | Bal. |
| Comparative Example | J | 0.19 | 0.10 | 1.5 | 0.06 | 2.9 | 0.06 | 6.3 | 0.12 | 0.14 | Bal. |
| | K | 0.18 | 0.12 | 1.9 | 0.10 | 3.2 | 0.08 | 14.2 | 0.22 | 0.09 | Bal. |
| | L | 0.21 | 0.14 | 2.3 | 0.09 | 1.1 | 0.07 | 11.0 | 0.35 | 0.20 | Bal. |
| | M | 0.22 | 0.10 | 2.2 | 0.12 | 5.2 | 0.06 | 9.5 | 0.09 | 0.10 | Bal. |
| | N | 0.15 | 0.15 | 0.7 | 0.03 | 1.9 | 0.03 | 9.9 | 0.06 | 0.13 | Bal. |
| | O | 0.25 | 0.09 | 3.6 | 0.06 | 3.0 | 0.08 | 8.9 | <0.01 | 0.08 | Bal. |
| | P | 0.20 | 0.20 | 2.2 | 0.15 | 4.2 | 0.10 | 11.0 | 0.18 | 0.02 | Bal. |
| | Q | 0.30 | 0.19 | 1.8 | 0.13 | 2.5 | 0.03 | 10.5 | 0.11 | 0.39 | Bal. |
| | R | 0.72 | 0.22 | 2.0 | 0.10 | 3.2 | <0.01 | 9.0 | 0.09 | 0.15 | Bal. |
| | S | 0.40 | 0.83 | 2.5 | 0.08 | 2.7 | 0.06 | 9.6 | 0.15 | 0.20 | Bal. |
| | T | 0.19 | 0.20 | 1.7 | 0.06 | 4.0 | 0.13 | 11.3 | 0.70 | 0.18 | Bal. |
| | U | 0.32 | 0.15 | 2.1 | 0.45 | 3.5 | 0.03 | 7.9 | 0.09 | 0.13 | Bal. |
| | V | 0.22 | 0.09 | 2.3 | <0.01 | 3.0 | 0.39 | 8.0 | 0.03 | 0.11 | Bal. |

Next, the ingots made from the aluminum alloys A to V were subject to homogenization treatment at a temperature of 450° C. for 10 hours, and then hot-rolled under the following conditions: the rolling start temperature was 400° C.; the strain rate was 0.3 $s^{-1}$; the reduction ratio per 1 pass was 1% or more; the total number of passes was 50 passes in which reverse rolling was carried out for 40 passes out of the 50 passes (i.e., 80% of the total number of passes). Consequently, hot-rolled plates having a plate thickness of 20 mm (the total reduction ratio was 96%) were obtained. The various hot-rolled plates obtained were solution-treated at a temperature of 450° C. for 3 hours and then, water-quenched to be cooled down to 75° C. or below in 50 seconds. Subsequently, artificial aging treatment was carried out at a temperature of 140° C. for 10 hours.

Then, the various structural aluminum alloy plates obtained were referred to as Test Materials 1 to 22, each of which was measured at room temperature with respect to tensile strength, 0.2% yield strength, and elongation at break. The results are shown in Table 2. The methods used to measure tensile strength, 0.2% yield strength, and elongation at break were in accordance with a test method specified in Japan Industrial Standards (JIS) as a tensile testing method for metallic materials (see, JIS No.: JISZ2241). Tensile directions used for the tensile test were three directions in total: a direction of 0 degree relative to, a direction of 45 degrees relative to, and a direction of 90 degrees relative to a rolling direction (a longitudinal rolling direction) (hereinafter, simply referred to as "0-degree direction", "45-degree direction", and "90-degree direction", respectively).

Moreover, the textures were measured in the following steps. Test pieces were obtained in the following manner. A central portion in the width direction of each of the plate-like test materials is cut to have a size of 25 mm length and 25 mm width. These portions were collected, and face-worked, until its plate thickness reaches one second of the original plate thickness, with its surface thereof perpendicular to the thickness direction being used as a measurement surface. Thereafter, these portions were finish-ground with SiC grinding paper (ϕ305 mm, Grit 2400) manufactured by Marumoto Struers Kabushiki Kaisha.

Then, these portions were corroded, for around 10 seconds, by a corrosive liquid that was a mixture of nitric acid, hydrochloric acid, and hydrogen fluoride. As a result, test pieces for pole-figure measurement by X-ray reflectometry were prepared. A pole figure for each of the obtained test pieces was made by X-ray reflectometry, and three-dimensional orientation analysis was carried out by a series expansion method using spherical harmonics. Thereby, orientation density of each of the orientations was determined.

TABLE 2

Crystal Orientation Density and Mechanical Properties of Each Test Material

| | Alloy Type | Test Material | Orientation Density of Each Crystal Orientation (in random ratio) | | | | | | | | Tensile Test 0-degree orientation | | | Tensile Test 45-degree orientation | | | Tensile Test 90-degree orientation | | | Total Evaluation |
|---|---|---|---|---|---|---|---|---|---|---|---|---|---|---|---|---|---|---|---|---|
| | | | B | S | Co | Cu | CR | Go | RW | P | Tensile Strength (MPa) | 0.2% Yield Strength (MPa) | Elongation at Break (%) | Tensile Strength (MPa) | 0.2% Yield Strength (MPa) | Elongation at Break (%) | Tensile Strength (MPa) | 0.2% Yield Strength (MPa) | Elongation at Break (%) | |
| Embodiment | A | 1 | 27 | 22 | 19 | 4 | 2 | 2 | 2 | 2 | 767 | 732 | 12 | 702 | 683 | 14 | 743 | 712 | 12 | Good |
| | B | 2 | 25 | 20 | 17 | 3 | 3 | 1 | 1 | 3 | 712 | 653 | 13 | 683 | 613 | 15 | 701 | 632 | 13 | Good |
| | C | 3 | 22 | 22 | 19 | 2 | 1 | 3 | 2 | 2 | 762 | 711 | 10 | 722 | 677 | 12 | 743 | 695 | 11 | Good |
| | D | 4 | 26 | 23 | 18 | 3 | 4 | 2 | 2 | 1 | 682 | 633 | 12 | 632 | 592 | 14 | 670 | 621 | 11 | Good |
| | E | 5 | 23 | 20 | 16 | 2 | 3 | 2 | 3 | 2 | 758 | 722 | 10 | 698 | 643 | 13 | 730 | 695 | 10 | Good |
| | F | 6 | 22 | 19 | 17 | 1 | 2 | 1 | 1 | 3 | 672 | 625 | 14 | 648 | 583 | 17 | 663 | 608 | 12 | Good |
| | G | 7 | 21 | 16 | 14 | 3 | 2 | 1 | 1 | 4 | 745 | 703 | 10 | 683 | 610 | 13 | 720 | 683 | 11 | Good |
| | H | 8 | 24 | 15 | 12 | 5 | 1 | 3 | 3 | 1 | 744 | 712 | 15 | 693 | 652 | 17 | 712 | 655 | 14 | Good |
| | I | 9 | 20 | 20 | 15 | 6 | 1 | 4 | 3 | 2 | 721 | 683 | 10 | 660 | 612 | 13 | 695 | 632 | 10 | Good |
| Comparative Example | J | 10 | 22 | 19 | 16 | 3 | 4 | 5 | 2 | 5 | 642 | 595 | 14 | 593 | 545 | 17 | 633 | 585 | 14 | Not Good |
| | K | 11 | 23 | 20 | 16 | 2 | 4 | 5 | 2 | 3 | 752 | 715 | 6 | 693 | 633 | 7 | 732 | 701 | 5 | Not Good |
| | L | 12 | 20 | 16 | 13 | 6 | 3 | 3 | 1 | 2 | 635 | 583 | 16 | 599 | 542 | 18 | 623 | 577 | 15 | Not Good |
| | M | 13 | 21 | 21 | 20 | 5 | 2 | 3 | 2 | 1 | 735 | 692 | 7 | 701 | 652 | 8 | 723 | 677 | 6 | Not Good |
| | N | 14 | 22 | 20 | 19 | 4 | 5 | 2 | 3 | 2 | 629 | 584 | 13 | 582 | 544 | 15 | 610 | 571 | 12 | Not Good |
| | O | 15 | 24 | 18 | 14 | 7 | 6 | 1 | 1 | 2 | 736 | 707 | 8 | 683 | 621 | 9 | 730 | 695 | 8 | Not Good |
| | P | 16 | 4 | 3 | 3 | 13 | 3 | 5 | 3 | 12 | 597 | 532 | 16 | 453 | 411 | 25 | 583 | 519 | 14 | Not Good |
| | Q | 17 | 21 | 16 | 11 | 2 | 2 | 4 | 2 | 4 | 744 | 699 | 5 | 703 | 666 | 5 | 725 | 680 | 5 | Not Good |
| | R | 18 | 22 | 20 | 13 | 3 | 4 | 3 | 2 | 4 | 732 | 688 | 3 | 673 | 621 | 4 | 713 | 677 | 2 | Not Good |
| | S | 19 | 25 | 23 | 16 | 6 | 1 | 2 | 2 | 3 | 721 | 679 | 4 | 680 | 637 | 5 | 705 | 663 | 3 | Not Good |
| | T | 20 | 26 | 22 | 15 | 5 | 2 | 2 | 1 | 3 | 712 | 688 | 6 | 677 | 651 | 7 | 695 | 661 | 6 | Not Good |
| | U | 21 | 24 | 19 | 14 | 4 | 3 | 1 | 1 | 2 | 706 | 673 | 7 | 611 | 580 | 8 | 688 | 621 | 7 | Not Good |
| | V | 22 | 23 | 16 | 15 | 2 | 4 | 1 | 3 | 3 | 724 | 689 | 7 | 683 | 621 | 7 | 713 | 670 | 6 | Not Good |

*The symbols of the crystal orientations in the table correspond to crystal orientations as follows.
B: Brass orientation,
S: S orientation,
Co: Copper orientaion,
Cu: Cube orientation,
CR: CR orientation,
Go: Goss orientation,
RW: RW orientation, and
P: P orientation.

As is clear from the results in Table 2, Test Materials 1 to 9 of structural aluminum alloy plates were obtained by using aluminum alloys A to I containing chemical compositions within the scope of the present invention, and all of Test Materials 1 to 9 exhibited the following excellent properties: tensile strength in each of the 0-degree direction and the 90-degree direction was 660 MPa or more; 0.2% yield strength in each of the 0-degree direction and the 90-degree direction was 600 MPa or more; elongation at break in each of the 0-degree direction and the 90-degree direction was 70% or more of elongation at break in the 45-degree direction; tensile strength in the 45-degree direction was 80% or more of tensile strength in the 0-degree direction, and 0.2% yield strength in the 45-degree direction was 80% or more of 0.2% yield strength in the 0-degree direction; and elongation at break in the 45-degree direction was 12% or more.

In contrast, Test Materials 10 to 22 of aluminum alloy plates were obtained by using aluminum alloys J to V containing chemical components that were outside of the scope of the present invention, and some of the components had too little or too much amounts contained in the aluminum alloys. Consequently, at least, orientation densities of the crystal orientations, or mechanical properties (tensile strength, 0.2% yield strength, and elongation at break) of Test Materials 10 to 22 were outside the scope of the present invention.

Specifically, in Test Material 10, aluminum alloy J having Zn content of less than 7.0% was used and thus, the effect of improving the strength was not obtained. The tensile strength in each of the 0-degree direction and the 90-degree direction was less than 660 MPa, and the 0.2% yield strength in each of the 0-degree direction and the 90-degree direction was less than 600 MPa.

Moreover, in Test Material 11, aluminum alloy K having Zn content of more than 12.0% was used and thus, Zn—Mg based crystallized products and precipitates were formed. The ductility was decreased, and the elongation at break in the 45-degree direction was less than 12%.

Furthermore, in Test Material 12, aluminum alloy L having Mg content of less than 1.5% was used and thus, the effect of improving the strength was not obtained. The tensile strength in each of the 0-degree direction and the 90-degree direction was less than 660 MPa, and the 0.2% yield strength in the 0-degree direction and the 90-degree direction was less than 600 MPa.

Moreover, in Test Material 13, aluminum alloy M having Mg content of more than 4.5% was used and thus, Zn—Mg based and Al—Mg—Cu based crystallized products and precipitates were formed. The ductility was decreased, and the elongation at break in the 45-degree direction was less than 12%.

Furthermore, in Test Material 14, aluminum alloy N having Cu content of less than 1.0% was used and thus, the effect of improving the strength was not obtained. The tensile strength in each of the 0-degree direction and the 90-degree direction was less than 660 MPa, and the 0.2% yield strength in each of the 0-degree direction and the 90-degree direction was less than 600 MPa.

Moreover, in Test Material 15, aluminum alloy 0 having Cu content of more than 3.0% was used and thus, Al—Cu based and Al—Mg—Cu based crystallized products and precipitates were formed. The ductility was decreased, and the elongation at break in the 45-degree direction was less than 12%.

Furthermore, in Test Material 16, aluminum alloy P having Zr content of less than 0.05% was used and thus, a recrystallization texture was formed. The effect of improving the strength was not obtained. The tensile strength in each of the 0-degree direction and the 90-degree direction was less than 660 MPa. The 0.2% yield strength in each of the 0-degree direction and the 90-degree direction was less than 600 MPa.

Moreover, in Test Material 17, aluminum alloy Q having Zr content of more than 0.30% was used and thus, Al—Zr based crystallized products and precipitates were formed. The ductility was decreased, and elongation at break in the 45-degree direction was less than 12%.

Furthermore, in Test Material 18, aluminum alloy R having Si content of more than 0.5% was used and thus, Al—Fe—Si based and Si based crystallized products and precipitates were formed. The ductility was decreased, and the elongation at break in the 45-degree direction was less than 12%.

Moreover, in Test Material 19, aluminum alloy S having Fe content of more than 0.5% was used and thus, Al—Fe—Si based and Al—Fe based crystallized products and precipitates were formed. The ductility was decreased, and the elongation at break in the 45-degree direction was less than 12%.

Furthermore, in Test Material 20, aluminum alloy T having Ti content of more than 0.5% was used and thus, Al—Ti based crystallized products and precipitates were formed. The ductility was decreased, and the elongation at break in the 45-degree direction was less than 12%.

Moreover, in Test Material 21, aluminum alloy U having Mn content of more than 0.3% was used and thus, Al—Mn based and Al—Fe—Si—Mn based crystallized products and precipitates were formed. The ductility was decreased, and the elongation at break in the 45-degree direction was less than 12%.

Furthermore, in Test Material 22, aluminum alloy V having Cr content of more than 0.3% was used and thus, Al—Cr based crystallized products and precipitates were formed. The ductility was decreased, and the elongation at break in the 45-degree direction was less than 12%.

Embodiment 2

In Embodiment 2, firstly, a DC ingot with a thickness of 500 mm and a width of 500 mm was obtained; the DC ingot had a chemical composition comprising 10.2% of Zn, 2.9% of Mg, 1.8% of Cu, 0.16% of Zr, 0.22% of Si, 0.13% of Fe, 0.05% of Ti, 0.02% of Mn, and 0.01% of Cr, and the balance aluminum with inevitable impurities.

Next, the resulting aluminum alloy ingots were treated under forging conditions, hot rolling conditions, cold rolling conditions, solution treatment conditions, quenching conditions, and artificial-aging treatment conditions, which are shown in Table 3. As a result, Test Materials 23 to 44 of various structural aluminum alloy plates each having a plate thickness of 2.0 mm were obtained.

TABLE 3

Production Condition of Each Test Material

| Test Material | Free Forging | Total Reduction Rate (%) | Strain Rate ($S^{-1}$) | Minimum Value of Reduction Rate Per Pass (%) | Total Number of Pass | Ratio of Reverse Rolling to Total Pass (%) | Start Temperature (° C.) | Cold Rolling | Solution Treatment Temperature (° C.) | Solution Treatment Time (h) | Quenching Time for Reaching 90° C. (s) | Artificial Aging Treatment Temperature (° C.) | Artificial Aging Treatment Time (h) |
|---|---|---|---|---|---|---|---|---|---|---|---|---|---|
| 23 | Done | 93 | 0.2 | 1.3 | 58 | 75 | 356 | No | 450 | 2 | 42 | 140 | 10 |
| 24 | Done | 98 | 1.2 | 3.6 | 55 | 96 | 405 | Done | 465 | 3 | 55 | 120 | 20 |
| 25 | No | 97 | 12.3 | 1.6 | 35 | 65 | 396 | Done | 470 | 3 | 48 | 130 | 20 |
| 26 | No | 92 | 5.6 | 1.0 | 68 | 70 | 345 | No | 470 | 3 | 33 | 150 | 10 |
| 27 | Done | 67 | 0.9 | 2.0 | 51 | 86 | 329 | No | 475 | 1 | 38 | 150 | 12 |
| 28 | No | 91 | 0.002 | 1.6 | 46 | 59 | 410 | Done | 475 | 3 | 56 | 135 | 16 |
| 29 | Done | 93 | 353 | 3.2 | 39 | 68 | 359 | No | 465 | 2 | 49 | 125 | 18 |
| 30 | Done | 90 | 3.5 | 1.6 | 26 | 74 | 367 | Done | 385 | 8 | 45 | 140 | 16 |
| 31 | No | 95 | 4.6 | 3.5 | 56 | 90 | 329 | No | 515 | 3 | 36 | 135 | 20 |
| 32 | Done | 98 | 0.6 | 2.4 | 44 | 81 | 397 | No | 460 | 0.5 | 26 | 155 | 15 |
| 33 | No | 94 | 0.8 | 1.1 | 32 | 77 | 369 | Done | 475 | 18 | 33 | 125 | 25 |
| 34 | No | 91 | 0.4 | 2.4 | 60 | 80 | 410 | Done | 455 | 3 | 85 | 170 | 8 |
| 35 | Done | 90 | 1.6 | 2.6 | 26 | 68 | 379 | No | 435 | 8 | 53 | 70 | 28 |

TABLE 3-continued

Production Condition of Each Test Material

| Test Material | Free Forging | Total Reduction Rate (%) | Strain Rate ($S^{-1}$) | Minimum Value of Reduction Rate Per Pass (%) | Total Number of Pass | Ratio of Reverse Rolling to Total Pass (%) | Start Temperature (° C.) | Cold Rolling | Solution Treatment Temperature (° C.) | Solution Treatment Time (h) | Quenching Time for Reaching 90° C. (s) | Artificial Aging Treatment Temperature (° C.) | Artificial Aging Treatment Time (h) |
|---|---|---|---|---|---|---|---|---|---|---|---|---|---|
| 36 | No | 98 | 2.8 | 2.0 | 48 | 76 | 346 | No | 480 | 2 | 46 | 215 | 10 |
| 37 | No | 93 | 0.7 | 3.6 | 52 | 89 | 394 | Done | 455 | 6 | 33 | 165 | 45 |
| 38 | Done | 96 | 0.3 | 1.6 | 39 | 60 | 356 | No | 465 | 5 | 23 | 140 | 2 |
| 39 | Done | 91 | 0.3 | 0.2 | 28 | 73 | 347 | No | 450 | 6 | 43 | 120 | 25 |
| 40 | No | 95 | 1.2 | 1.2 | 7 | 90 | 333 | No | 465 | 5 | 29 | 155 | 10 |
| 41 | No | 96 | 0.8 | 1.9 | 94 | 85 | 413 | Done | 435 | 9 | 46 | 115 | 27 |
| 42 | Done | 93 | 1.6 | 2.2 | 63 | 21 | 405 | Done | 440 | 8 | 55 | 170 | 15 |
| 43 | No | 94 | 2.0 | 2.9 | 45 | 68 | 256 | No | 475 | 3 | 27 | 140 | 20 |
| 44 | No | 92 | 1.1 | 3.3 | 49 | 59 | 468 | Done | 435 | 8 | 19 | 165 | 10 |

The resulting various test materials were measured with respect to tensile strength, 0.2% yield strength, and elongation at break at room temperature; the results are shown in Table 4. The methods used to measure tensile strength, 0.2% yield strength, and elongation at break were in accordance with a test method specified in Japan Industrial Standards (JIS) as a tensile testing method for metallic materials (see, JIS No.: JISZ2241). Tensile directions used for the tensile test were three directions in total: the 0-degree direction, the 45-degree direction, and the 90-degree direction from the rolling direction (the longitudinal rolling direction).

Moreover, the textures were measured in the following steps. Test pieces were obtained in the following manner. A central portion in the width direction of each of the plate-like test materials is cut to have a size of 25 mm length and 25 mm width. These portions were collected, and face-worked, until its plate thickness reaches one second of the original plate thickness, with its surface thereof perpendicular to the thickness direction being used as a measurement surface. Thereafter, these portions were finish-ground with SiC grinding paper (ϕ305 mm, Grit 2400) manufactured by Marumoto Struers Kabushiki Kaisha.

Then, these portions were corroded, for around 10 seconds, by a corrosive liquid that was a mixture of nitric acid, hydrochloric acid, and hydrogen fluoride. As a result, test pieces for pole-figure measurement by X-ray reflectometry were prepared. A pole figure for each of the obtained test pieces was made by X-ray reflectometry, and three-dimensional orientation analysis was carried out by a series expansion method using spherical harmonics. Thereby, orientation density of each of the orientations was determined.

TABLE 4

Crystal Orientation Density and Mechanical Properties of Each Test Material

| Test Material | Orientation Density of Each Crystal Orientation (random ratio) B | S | Co | Cu | CR | Go | RW | P | Tensile Test: 0-degree orientation Tensile Strength (MPa) | 0-degree orientation 0.2% Yield Strength (MPa) | 0-degree orientation Elongation at Break (%) | 45-degree orientation Tensile Strength (MPa) | 45-degree orientation 0.2% Yield Strength (MPa) | 45-degree orientation Elongation at Break (%) | 90-degree orientation Tensile Strength (MPa) | 90-degree orientation 0.2% Yield Strength (MPa) | 90-degree orientation Elongation at Break (%) | Total Evaluation |
|---|---|---|---|---|---|---|---|---|---|---|---|---|---|---|---|---|---|---|
| 23 | 25 | 20 | 16 | 4 | 2 | 1 | 2 | 1 | 752 | 721 | 12 | 698 | 666 | 14 | 740 | 710 | 11 | Good |
| 24 | 18 | 22 | 27 | 3 | 3 | 2 | 1 | 2 | 763 | 731 | 12 | 705 | 685 | 13 | 755 | 721 | 12 | Good |
| 25 | 16 | 20 | 25 | 5 | 1 | 3 | 3 | 4 | 748 | 718 | 10 | 680 | 653 | 12 | 735 | 703 | 11 | Good |
| 26 | 23 | 19 | 15 | 2 | 2 | 4 | 2 | 3 | 721 | 692 | 10 | 653 | 622 | 13 | 711 | 680 | 10 | Good |
| 27 | 15 | 10 | 6 | 3 | 1 | 4 | 2 | 3 | 643 | 582 | 15 | 503 | 453 | 23 | 630 | 571 | 14 | Not Good |
| 28 | 13 | 12 | 10 | 4 | 3 | 5 | 4 | 2 | 625 | 573 | 13 | 477 | 425 | 20 | 621 | 559 | 11 | Not Good |
| 29 | 35 | 32 | 28 | 2 | 2 | 2 | 4 | 1 | 782 | 743 | 10 | 721 | 703 | 12 | 769 | 723 | 11 | Good |
| 30 | 15 | 18 | 22 | 3 | 2 | 3 | 1 | 2 | 634 | 592 | 9 | 553 | 498 | 11 | 631 | 593 | 8 | Not Good |
| 31 | Partial dissolution during the solution treatmeant. | | | | | | | | | | | | | | | | | Not Good |
| 32 | 24 | 20 | 14 | 4 | 4 | 2 | 2 | 4 | 621 | 583 | 9 | 542 | 483 | 10 | 603 | 571 | 9 | Not Good |
| 33 | 4 | 4 | 7 | 12 | 4 | 10 | 2 | 14 | 581 | 555 | 16 | 441 | 415 | 24 | 572 | 548 | 13 | Not Good |
| 34 | 16 | 22 | 24 | 3 | 3 | 4 | 3 | 2 | 633 | 602 | 8 | 531 | 493 | 10 | 623 | 585 | 7 | Not Good |
| 35 | 23 | 21 | 16 | 5 | 5 | 7 | 3 | 3 | 644 | 611 | 13 | 542 | 511 | 14 | 640 | 593 | 12 | Not Good |
| 36 | 21 | 18 | 15 | 4 | 5 | 6 | 4 | 3 | 651 | 618 | 12 | 531 | 500 | 11 | 633 | 602 | 10 | Not Good |
| 37 | 12 | 18 | 23 | 3 | 6 | 4 | 2 | 4 | 642 | 608 | 11 | 529 | 493 | 13 | 653 | 616 | 10 | Not Good |
| 38 | 23 | 19 | 16 | 1 | 2 | 3 | 2 | 2 | 633 | 594 | 13 | 543 | 483 | 13 | 644 | 601 | 12 | Not Good |
| 39 | 8 | 9 | 7 | 3 | 4 | 3 | 3 | 4 | 573 | 549 | 14 | 450 | 416 | 21 | 562 | 544 | 13 | Not Good |
| 40 | 4 | 5 | 8 | 13 | 5 | 4 | 18 | 10 | 589 | 543 | 11 | 453 | 402 | 17 | 595 | 532 | 12 | Not Good |
| 41 | 6 | 4 | 3 | 5 | 3 | 2 | 8 | 3 | 591 | 552 | 10 | 462 | 411 | 15 | 583 | 546 | 10 | Not Good |
| 42 | 8 | 6 | 4 | 14 | 2 | 5 | 8 | 13 | 582 | 534 | 12 | 453 | 419 | 18 | 577 | 530 | 12 | Not Good |

TABLE 4-continued

Crystal Orientation Density and Mechanical Properties of Each Test Material

| Test | Orientation Density of Each Crystal Orientation (random ratio) | | | | | | | | Tensile Test | | | | | | | | | |
|---|---|---|---|---|---|---|---|---|---|---|---|---|---|---|---|---|---|---|
| | | | | | | | | | 0-degree orientation | | | 45-degree orientation | | | 90-degree orientation | | | |
| Material | B | S | Co | Cu | CR | Go | RW | P | Tensile Strength (MPa) | 0.2% Yield Strength (MPa) | Elongation at Break (%) | Tensile Strength (MPa) | 0.2% Yield Strength (MPa) | Elongation at Break (%) | Tensile Strength (MPa) | 0.2% Yield Strength (MPa) | Elongation at Break (%) | Total Evaluation |
| 43 | 4 | 3 | 5 | 16 | 3 | 5 | 11 | 8 | 571 | 543 | 13 | 443 | 429 | 20 | 582 | 540 | 12 | Not Good |
| 44 | 5 | 5 | 6 | 13 | 2 | 6 | 10 | 10 | 586 | 532 | 10 | 452 | 411 | 18 | 573 | 529 | 11 | Not Good |

*The symbols of the crystal orientations in the table correspond to crystal orientations as follows.
B: Brass orientation,
S: S orientation,
Co: Copper orientaion,
Cu: Cube orientation,
CR: CR orientation,
Go: Goss orientation,
RW: RW orientation, and
P: P orientation.

As is clear from the results in Table 3 and Table 4, Test Materials 23 to 26, and 29 were obtained by adopting various conditions that fall within the scope of the production method of the present invention (i.e., forging conditions, hot rolling conditions, cold rolling conditions, solution treatment conditions, quenching conditions, and artificial-aging treatment conditions), and all of Test Materials 23 to 26, and 29 exhibited excellent properties in tensile strength, 0.2% yield strength, and elongation at break.

In contrast, as for Test Materials 27, 28, 33 and 39 to 44 obtained by adopting various conditions that were outside of the scope of the production method of the present invention (i.e., forging conditions, hot rolling conditions, cold rolling conditions, solution treatment conditions, quenching conditions, and artificial aging treatment conditions), the textures were not sufficiently developed. Consequently, orientation density of the crystal orientations, and mechanical properties (tensile strength, 0.2% yield strength, and elongation at break) were outside the scope of the present invention. Alternatively, as for Test Materials 30, 32 and 34 to 38 obtained by adopting various conditions that were outside the scope of the production method of the present invention, mechanical properties (tensile strength, 0.2% yield strength, and elongation at break) were outside the scope of the present invention. Moreover, as for Test Material 31, the solution treatment temperature was outside the scope of the present invention, and partial melting was occurred during the solution treatment; consequently, a test material for evaluation could not be obtained.

Specifically, as for Test Material 27, because the total reduction ratio was less than 90%, the textures were not sufficiently developed; therefore, the effect of improving the strength was not obtained. The tensile strength in each of the 0-degree direction and the 90-degree direction was less than 660 MPa, and the 0.2% yield strength in each of the 0-degree direction and the 90-degree direction was less than 600 MPa. A large in-plane anisotropy was observed.

As for Test Material 28, because a strain rate in the hot rolling was less than 0.01 $s^{-1}$, the textures were not sufficiently developed; therefore, the effect of improving the strength was not obtained. The tensile strength in each of the 0-degree direction and the 90-degree direction was less than 660 MPa, and the 0.2% yield strength in each of the 0-degree direction and the 90-degree direction was less than 600 MPa. A large in-plane anisotropy was observed.

As for Test Material 30, because the solution treatment temperature was less than 400° C., dissolution was not sufficiently achieved. The tensile strength in each of the 0-degree direction and the 90-degree direction was less than 660 MPa, and the 0.2% yield strength in each of the 0-degree direction and the 90-degree direction was less than 600 MPa. The elongation at break in the 45-degree direction was less than 12%.

As for Test Material 32, the solution treatment time was less than 1 hour, and dissolution was not sufficiently achieved. The tensile strength in each of the 0-degree direction and the 90-degree direction was less than 660 MPa, and the 0.2% yield strength in each of the 0-degree direction and the 90-degree direction was less than 600 MPa, The elongation at break in the 45-degree direction was less than 12%.

As for Test Material 33, the solution treatment time was 10 hours or more, and recrystallization occurred. Consequently, the textures were not sufficiently developed, and the effect of improving the strength was not obtained. The tensile strength in each of the 0-degree direction and the 90-degree direction was less than 660 MPa, and the 0.2% yield strength in each of the 0-degree direction and the 90-degree direction was less than 600 MPa. A large in-plane anisotropy was observed.

As for Test Material 34, because Test Material 34 was not cooled down to a temperature of 90° C. or below within one minute during the quenching, dissolution was not sufficiently achieved. Consequently, the tensile strength in each of the 0-degree direction and the 90-degree direction was less than 660 MPa, and the 0.2% yield strength in the 90-degree direction was less than 600 MPa. The elongation at break in the 45-degree direction was less than 12%.

As for Test Material 35, because the artificial aging temperature was less than 80° C., the effect of improving the strength by enhanced precipitation was not obtained. The tensile strength in each of the 0-degree direction and the 90-degree direction was less than 660 MPa, and the 0.2% yield strength in the 90-degree direction was less than 600 MPa.

As for Test Material 36, because the artificial aging temperature was over 180° C., the effect of improving the strength by enhanced precipitation was not obtained. The tensile strength in each of the 0-degree direction and the 90-degree direction was less than 660 MPa. The elongation at break in the 45-degree direction was less than 12%.

As for Test Material 37, because the artificial aging time was over 30 hours, coarse precipitation occurs. Consequently, the effect of improving the strength was not obtained. The tensile strength in each of the 0-degree direction and the 90-degree direction was less than 660 MPa.

As for Test Material 38, because the artificial aging time was less than 5 hours, the effect of improving the strength by enhanced precipitation was not obtained. The tensile strength in each of the 0-degree direction and the 90-degree direction was less than 660 MPa, and the 0.2% yield strength in the 0-degree direction was less than 600 MPa.

As for Test Material 39, because the reduction ratio per 1 pass was less than 1%, the textures were not sufficiently developed. The tensile strength in each of the 0-degree direction and the 90-degree direction was less than 660 MPa, and the 0.2% yield strength in each of the 0-degree direction and the 90-degree direction was less than 600 MPa. A large in-plane anisotropy was observed.

As for Test Material 40, because the total number of rolling passes was less than 10 passes, the textures were not sufficiently developed. The tensile strength in each of the 0-degree direction and the 90-degree direction was less than 660 MPa, and the 0.2% yield strength in each of the 0-degree direction and the 90-degree direction was less than 600 MPa. A large in-plane anisotropy was observed.

As for Test Material 41, because the total number of rolling passes was over 70 passes, the textures were not sufficiently developed. The tensile strength in each of the 0-degree direction and the 90-degree direction was less than 660 MPa, and the 0.2% yield strength in each of the 0-degree direction and the 90-degree direction was less than 600 MPa. A large in-plane anisotropy was observed.

As for Test Material 42, because a ratio of the reverse rolling to the number of passes was less than 50%, the textures were not sufficiently developed. The tensile strength in each of the 0-degree direction and the 90-degree direction was less than 660 MPa, and the 0.2% yield strength in each of the 0-degree direction and the 90-degree direction was less than 600 MPa. A large in-plane anisotropy was observed.

As for Test Material 43, because the hot-rolling start temperature was less than 300° C., the textures were not sufficiently developed. The tensile strength in each of the 0-degree direction and the 90-degree direction was less than 660 MPa, and the 0.2% yield strength in each of the 0-degree direction and the 90-degree direction was less than 600 MPa. A large in-plane anisotropy was observed.

As for Test Material 44, because the hot-rolling start temperature was over 420° C., the textures were not sufficiently developed. The tensile strength in each of the 0-degree direction and the 90-degree direction was less than 660 MPa, and the 0.2% yield strength in each of the 0-degree direction and the 90-degree direction was less than 600 MPa. A large in-plane anisotropy was observed.

The invention claimed is:

1. A structural aluminum alloy plate comprising:
8.0% to 11.0% by mass of Zn;
1.5% to 4.5% by mass of Mg;
1.0% to 3.0% by mass of Cu;
0.05% to 0.30% by mass of Zr;
0.005% to 0.5% by mass of Ti,
0.5% or less by mass of Si;
0.5% or less by mass of Fe;
0.3% or less by mass of Mn;
0.3% or less by mass of Cr; and
the balance being aluminum and inevitable impurities,
wherein the structural aluminum alloy plate comprises a texture in which
an orientation density of at least one crystal orientation of three crystal orientations, which are Brass orientation, S orientation, and Copper orientation, is 20 or more with respect to a random ratio, and
orientation densities of all of five crystal orientations, which are Cube orientation, CR orientation, Goss orientation, RW orientation, and P orientation, are 10 or less with respect to a random ratio, and
wherein the structural aluminum alloy plate comprises:
a tensile strength of 660 MPa or more and a 0.2% yield strength of 600 MPa or more in each of a 0-degree direction and a 90-degree direction relative to a longitudinal rolling direction;
an elongation at break in each of the 0-degree direction and the 90-degree direction is 70% or more of an elongation at break in a 45-degree direction relative to the longitudinal rolling direction;
a tensile strength in the 45-degree direction is 80% or more of the tensile strength in the 0-degree direction, and a 0.2% yield strength in the 45-degree direction is 80% or more of the 0.2% yield strength in the 0-degree direction; and
wherein the elongation at break in the 45-degree direction is 12% or more.

2. The structural aluminum alloy plate according to claim 1, wherein the orientation densities of the Brass orientation and the S orientation are 20 or more with respect to the random ratio.

3. A structural aluminum alloy plate comprising:
7.0% to 12.0% by mass of Zn;
1.5% to 4.5% by mass of Mg;
1.0% to 3.0% by mass of Cu;
0.05% to 0.30% by mass of Zr;
0.005% to 0.5% by mass of Ti,
0.5% or less by mass of Si;
0.5% or less by mass of Fe;
0.3% or less by mass of Mn;
0.3% or less by mass of Cr; and
the balance being aluminum and inevitable impurities,
wherein the structural aluminum alloy plate comprises a texture in which
orientation densities of all of five crystal orientations, which are Cube orientation, CR orientation, Goss orientation, RW orientation, and P orientation, are 10 or less with respect to a random ratio, and
wherein the structural aluminum alloy plate comprises:
a tensile strength of 660 MPa or more and a 0.2% yield strength of 600 MPa or more in each of a 0-degree direction and a 90-degree direction relative to a longitudinal rolling direction;
an elongation at break in each of the 0-degree direction and the 90-degree direction is 70% or more of an elongation at break in a 45-degree direction relative to the longitudinal rolling direction;
a tensile strength in the 45-degree direction is 80% or more of the tensile strength in the 0-degree direction, and a 0.2% yield strength in the 45-degree direction is 80% or more of the 0.2% yield strength in the 0-degree direction; and wherein the elongation at break in the 45-degree direction is 12% or more, and orientation densities of Brass orientation and S orientation are 20 or more with respect to a random ratio.

* * * * *